US005413548A

United States Patent [19]

Hoffman

[11] Patent Number: 5,413,548

[45] Date of Patent: May 9, 1995

[54] BODY GYM EXERCISER

[76] Inventor: Ned Hoffman, 6009 Auburn Ave., Oakland, Calif. 94618

[21] Appl. No.: 143,840

[22] Filed: Oct. 27, 1993

[51] Int. Cl.[6] ..... A63B 21/045

[52] U.S. Cl. ..... 482/127; 482/126; 482/121; 482/122; 482/44

[58] Field of Search ..... 482/121, 122, 126, 127, 482/123, 125, 129, 130, 44, 49, 50, 139; 108/157, 187

[56] References Cited

U.S. PATENT DOCUMENTS

| | | | |
|---|---|---|---|
| 4,071,237 | 1/1978 | Hoogasian | 482/44 |
| 4,681,315 | 7/1987 | Yang | 482/127 |
| 4,718,666 | 1/1988 | O'Donnell et al. | 482/126 |
| 4,807,873 | 2/1989 | Naquin | 482/139 |

FOREIGN PATENT DOCUMENTS

| | | | |
|---|---|---|---|
| 0039613 | 11/1907 | Switzerland | 482/127 |

*Primary Examiner*—Richard J. Apley
*Assistant Examiner*—Lynne A. Reichard
*Attorney, Agent, or Firm*—Denton L. Anderson; Sheldon & Mak, Inc.

[57] ABSTRACT

A portable exercise device is provided which is inexpensive and easy to maintain while being capable of providing exercise to a wide variety of human muscles. The device has three padded parallel bars disposed in fixed relationship by a pair of arms. Although the two arms can be disposed in a single line, generally they are disposed to form a V-shape. A torsion device is provided to resist the swiveling of one arm with respect to the other.

19 Claims, 5 Drawing Sheets

FE=FORCE EXERCISE FO=FORCE OPPOSING

BODY GYM EXERCISER

FIELD OF THE INVENTION

This invention relates generally to exercise equipment and, specifically, to easily portable exercise equipment.

BACKGROUND OF THE INVENTION

Americans have become increasingly conscious of the need to exercise. Numerous medical studies conducted over the past 25 years have confirmed that people who habitually exercise lead healthier and longer lasting lives.

The market is presently inundated with various types of exercise equipment. Unfortunately, all of the known exercise equipment falls into one of two classes: (1) large, complex and expensive exercise equipment difficult to store in the home and virtually impossible to routinely transport; and (2) small, portable exercise equipment which is useful only in the exercise of a limited number of muscles.

Accordingly, there is a need for an inexpensive exercise apparatus which is capable of exercising a large variety of the user's muscles and which is small enough to be easily stored within the home and lightweight enough to be easily be carried with the user while traveling.

SUMMARY Off THE INVENTION

The present invention satisfies this need. The invention is a portable exercise device comprising:

(a) a first bar having a distal end and a proximal end;

(b) a first arm having a distal end and a proximal end, the proximal end of the first arm being attached to the proximal end of the first bar, such that the first bar and the first arm are disposed substantially at right angles;

(c) a second arm having a distal end and a proximal end, the proximal end of the second arm being swivably attached to an end of the first bar such that the first bar and the second arm are disposed substantially at right angles;

(d) a second bar having a distal end and a proximal end, the proximal end of the second bar being attached to the distal end of the first arm such that the second bar is disposed at substantially right: angles to the first arm and such that the second bar is disposed substantially parallel with the first bar;

(e) a third bar having a distal end and a proximal end, the proximal end of the third bar being attached to the distal end of the second arm such that the third bar is disposed at substantially right angles to the second arm and such that the third bar is disposed substantially parallel with the first and second bars; and (f) torsion means for resisting the swiveling of the second arm with respect to the first bar.

The torsion means exerts sufficient pressure to achieve a degree of exercise in the user. The torsion means can be a coil spring, a torsion bar or some other similarly suitable torsion means. Preferably, the torsion means is adjustable so that different muscles can be exercised with differing degrees of torsion resistance. Where the torsion means are not adjustable or when it is required to use torsion pressures which markedly differ from one another, it is preferably that the torsion means be readily interchangeable with like torsion means of differing strengths.

The device can either be E-shaped or S-shaped. Preferably, each of the three arms is padded with a durable material. Furthermore, it is preferably that the arms be adjustable in length so as to accommodate varying kinds of exercise and differing muscle groups.

DESCRIPTION OF THE DRAWINGS

These and other features, aspects and advantages of the present invention will become better understood with reference to the following description, appended claims and accompanying drawings where:

DETAILED DESCRIPTION OF THE INVENTION

Figure 1:
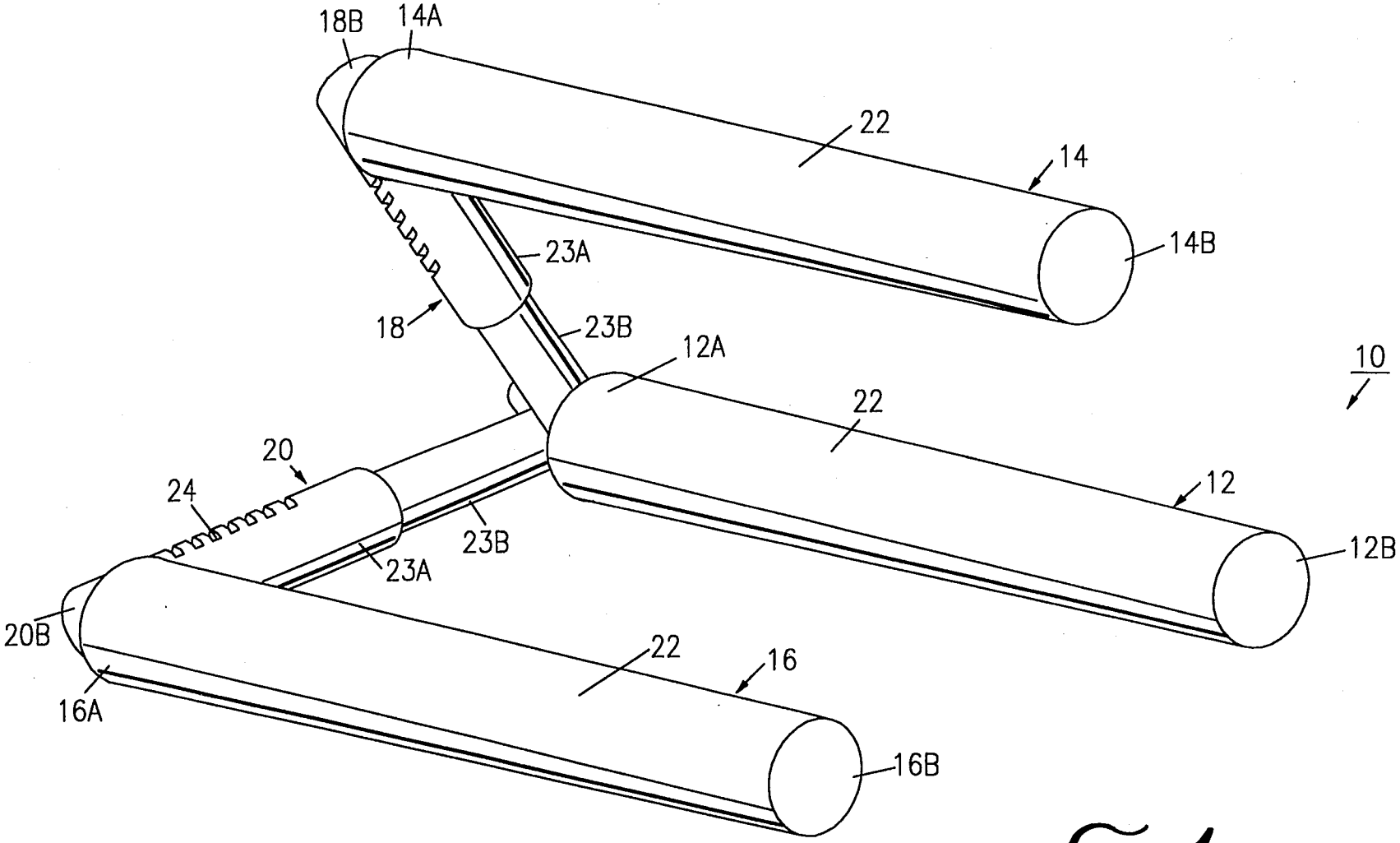
FIG. 1 is a prospective view of an exercise device having features of the invention.

The invention is a portable exercise device 10 comprising a first bar 12, a second bar 14, a third bar 16, a first arm 18 and a second arm 20. Each of the bars 12, 14 and 16 and each of the arms 18 and 20 has a proximal end 12*a*–20*a* 128 and a distal end 12*b*–20*b*. Each of the bars 12, 14 and 16 and each of the arms 18 and 20 can be constructed of any suitably rigid material. Preferably, for ease of manufacture and for good strength-to-weight ratio, each of the bars 12, 14 and 16 and each of the arms 18 and 20 is constructed of a metal, such as aluminum or steel.

Each of the bars 12, 14 and 16 is preferably padded with a durable foam material or other suitable padding material 22. The padding material 22 markedly increases the comfort to the user when using the device 10.

The device 10 can be constructed in an E-shape or in an S-shape. In either case, the proximal end of the first arm 18 is attached to the proximal end of the first bar 12, such that the first bar 12 and the first arm 18 are disposed at right angles. In the embodiment shown in the drawings, the first arm 18 is rigidly attached to the first bar 12, although this is not necessary. So long as the movement of the first arm 18 with respect to the first bar 12 is controlled, the first arm 18 can be swivably attached to the first bar 12.

Figure 2:
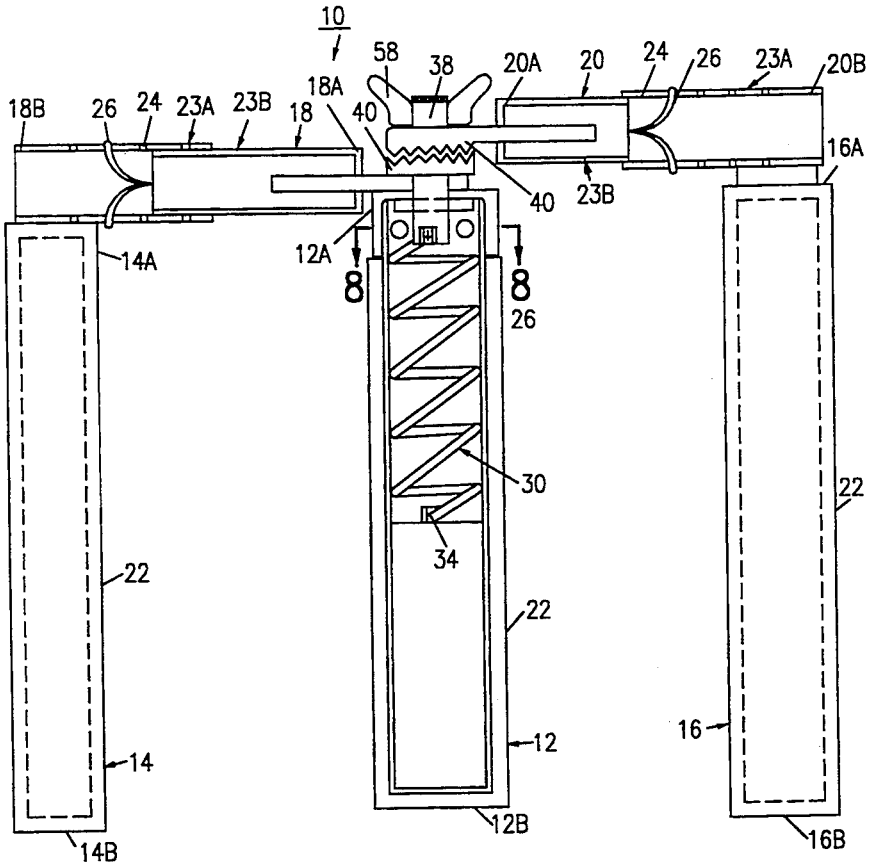
FIG. 2 is a side view in partial cross-section of a second exercise device having features of the invention.
Figure 3:
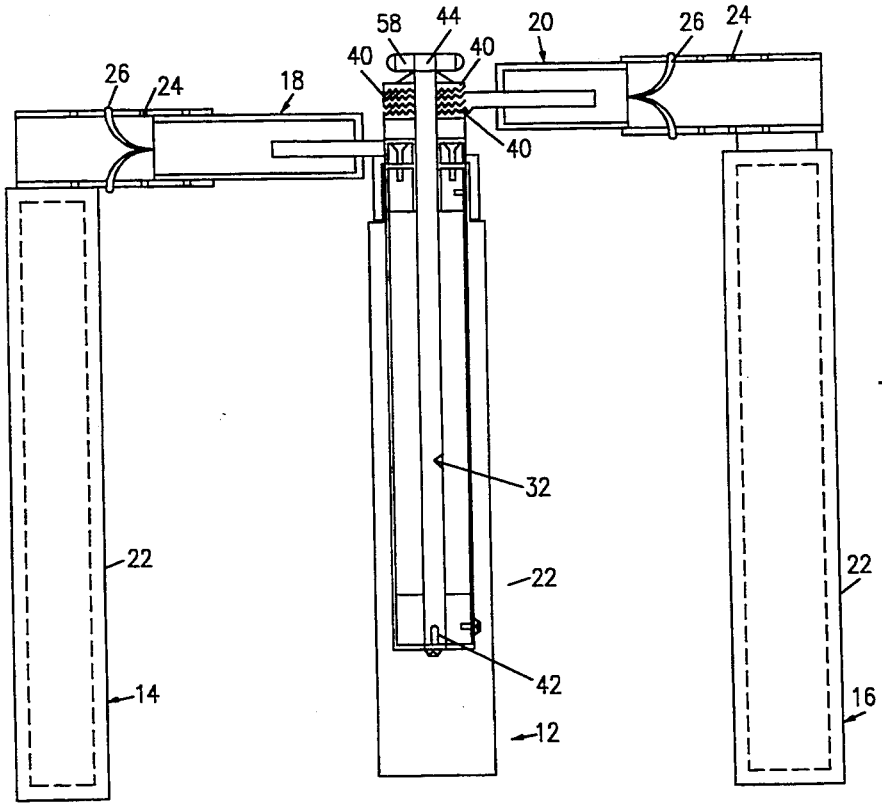
FIG. 3 is a side view in partial cross-section of a third exercise device having features of the invention.
Figure 10:
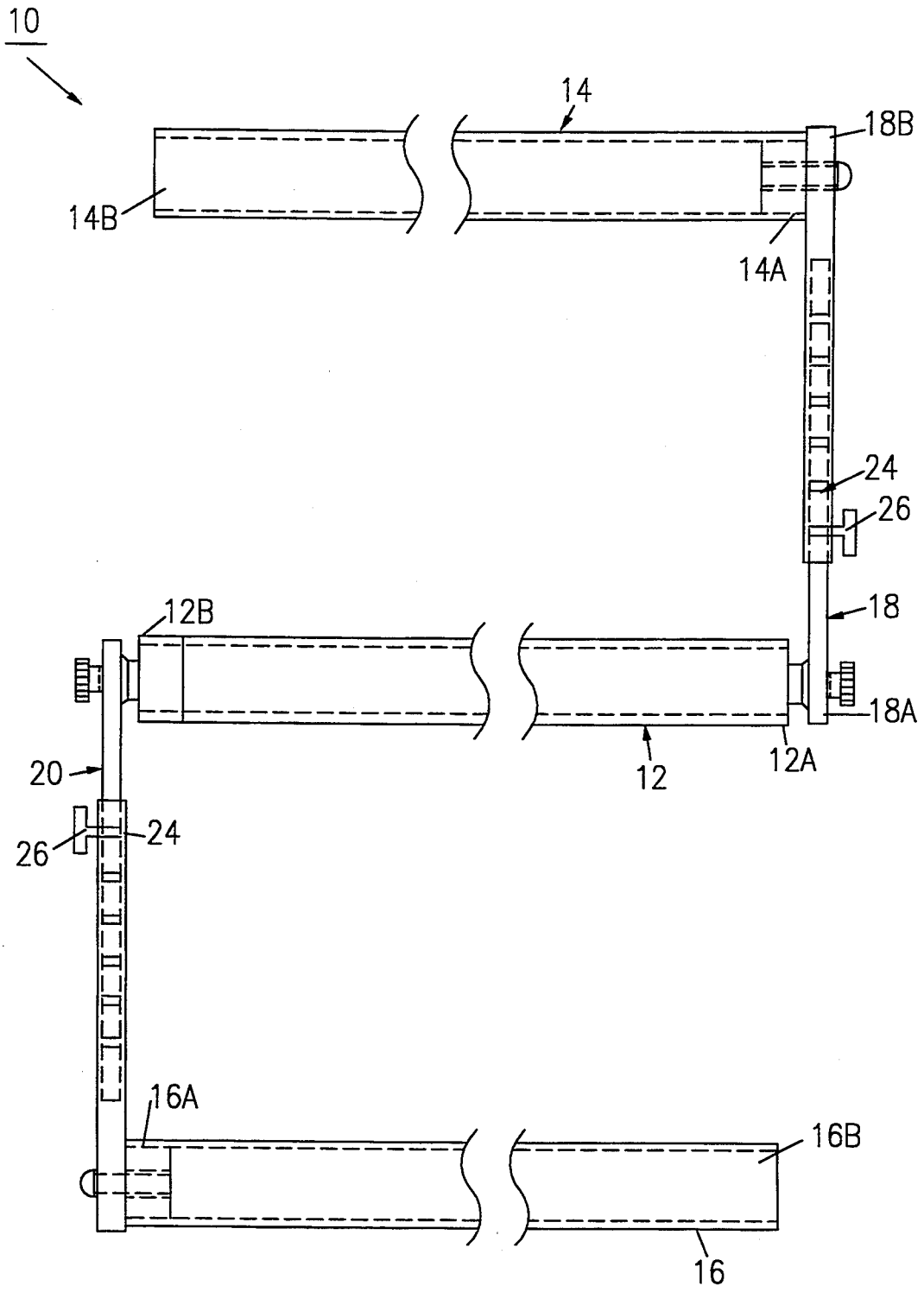
FIG. 10 is an alternative embodiment of an exerciser having features of the invention.

The proximal end of the second arm 20 is swivably attached to one end of the first bar 12, such that the first bar 12 and the second arm 20 are disposed substantially at right angles. When the second arm 20 is attached to the proximal end of the first bar 12, the resulting shape of the device 10 is E-shaped, as shown in FIGS. 1–3. When the second arm 20 is attached to the distal end of the first bar 12, the resulting shape of the device 10 is S-shaped, as shown in FIG. 10.

The proximal end of the second bar 14 is attached to the distal end of the first arm 18, such that the second bar 14 is disposed at substantially right angles to the first arm 18 and such that the second bar 14 is disposed substantially parallel with the first bar 12. The proximal end of the third bar 16 is attached to the distal end of the second arm 20, such that the third bar 16 is disposed at substantially right angles to the second arm 20 and such that the third bar 16 is disposed substantially parallel with the first and second bars 12 and 14.

Figure 11:
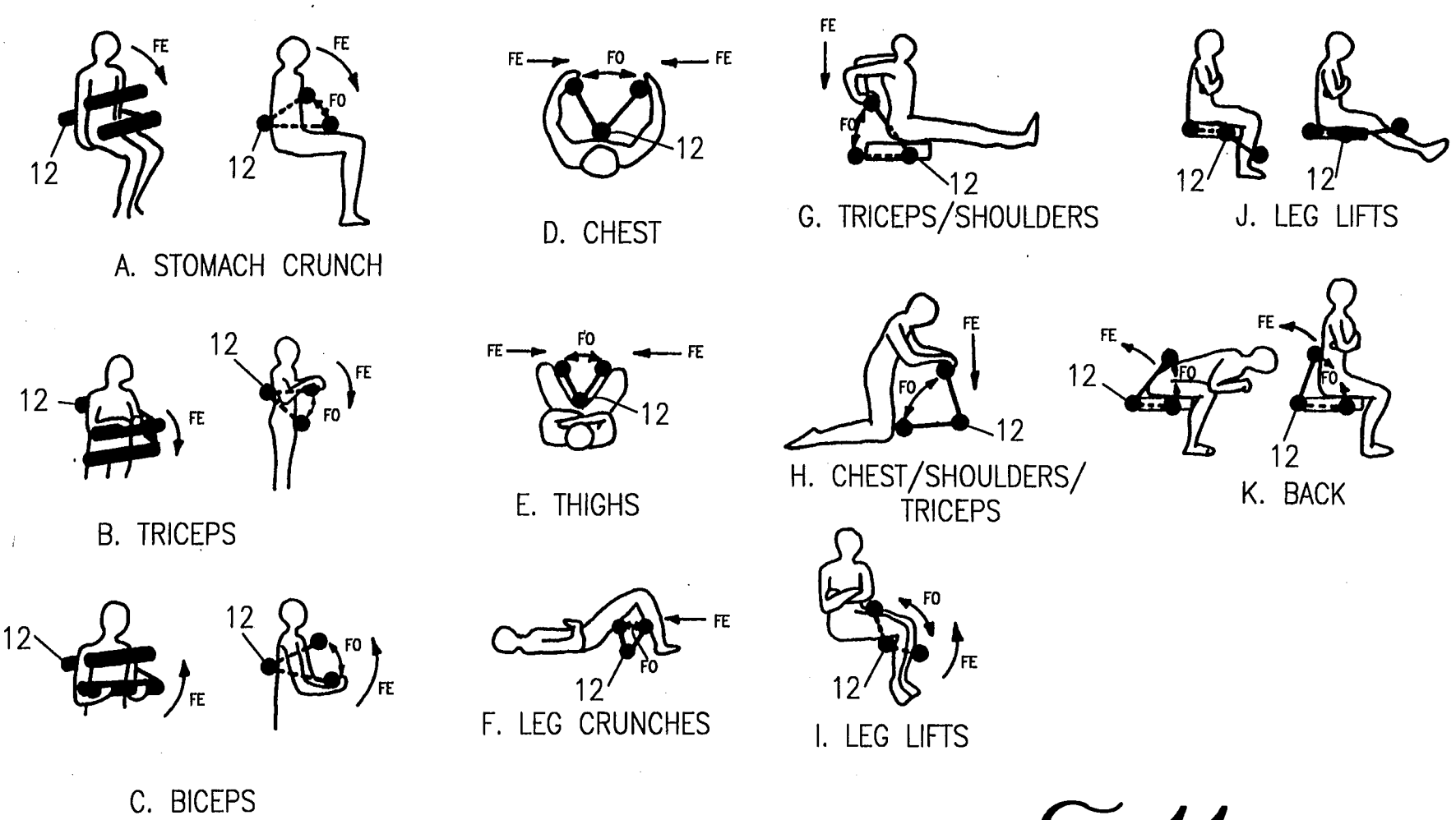
FIGS. 11*a–k* are eleven different illustrations of how a device having features of the invention can be used to exercise a wide variety of the user's muscles.

The first bar 12, the second bar 14 and the third bar are retained in spaced-apart, parallel relationship with one another solely by the first arm 18 and the second arm 20. In other words, each of the bars 12, 14 and 16 is attached at one end to one of the arms 18 or 20, and the other end of each of the bars 12, 14 and 16 is unattached to any structure. This allows the user to position his or her body between the bars 12, 14 and 16 as illustrated in FIG. 11.

Figure 9:
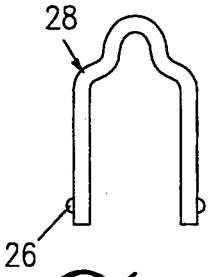
FIG. 9 is a detail of a U-shaped clip with detents useful as an alternative adjustment means to the two arms of the invention.

Preferably, the length of the arms 18 and 20 are adjustable to allow a greater or lesser distance between the three bars 12, 14 and 16. As shown in the drawings, the arms 18 and 20 can each be comprised of telescoping moieties 23*a* and 23*b*. This makes the arms 18 and 20 telescopically adjustable between predetermined matching notches 24, and held within a specified notch 24 by some form of pins 26. Such pins 26 can be spring steel prongs such as shown in FIGS. 2 and 3, or thumb screws such as shown in FIG. 10. Alternatively, a U-shaped bracket 28, such as illustrated in FIG. 9, can be affixed within the arms 18 and 20 and adapted to snap in and out of the notches 24 by detent-type pins 26 disposed within the two ends of the bracket 28.

The device 10 further incorporates torsion means for resisting the swiveling action of the second arm 20 with respect to the first bar 12. In those devices where the first arm 18 is free to swivel about the first bar 12, additional torsion means (not shown) are provided for resisting the swiveling of the first arm 18 with respect to the first bar 12.

Figure 4A:
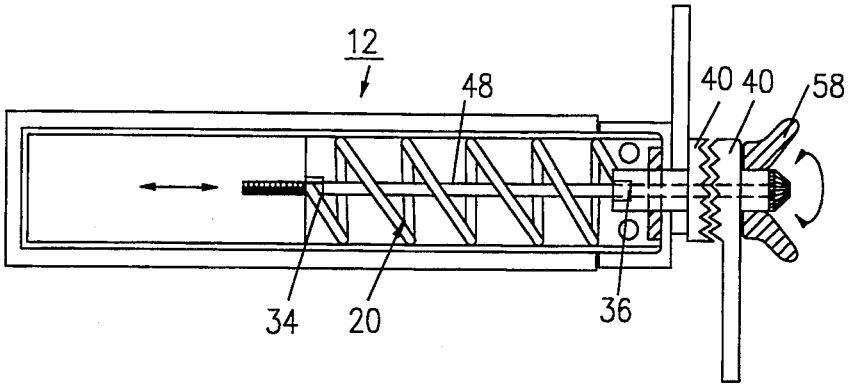
FIG. 4*a* is a side view in partial cross-section of a first bar useful in the invention illustrating how an adjustment bolt can be used to adjust the torsion strength of a spring disposed within the bar.
Figure 4B:
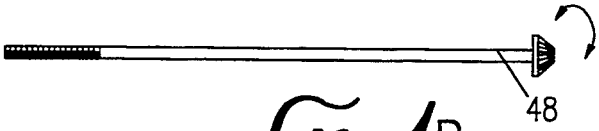
FIG. 4*b* is a side view of the adjustment bolt used in the embodiment of FIG. 4*a;*
Figure 8:
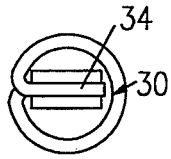
FIG. 8 is a detail of the spring attachment in FIG. 2 along line 8—8.

As shown in the drawings, the torsion means can comprise a coil spring 30 or a torsion bar 32. Other torsion means can also be used. A coil spring torsion means 30 is illustrated in FIGS. 2 and 4*a*. The coil spring 30 is disposed within the first bar 12. A first end 34 of the coil spring 30 is affixed to the first bar 12. A second end 36 of the coil spring 30 is affixed to a pivotable pin 38 which is linked to the second arm 20 via a pair of rachet washers 40.

Figure 6:
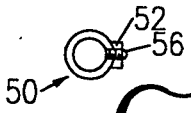
FIG. 6 is a side view of a ring useful in the embodiment illustrated in FIG. 5.
Figure 7:
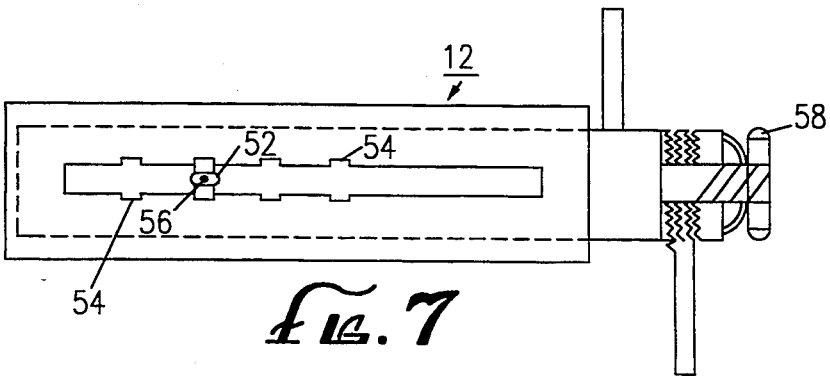
FIG. 7 is a side view of the first bar illustrated in FIG. 5.

A torsion bar torsion means 32 is illustrated in FIGS. 3, 6 and 7. The torsion bar 32 is disposed within the first bar 12. The torsion bar 32 has a first end 42 which is affixed to the first bar 12. The torsion bar 32 has a second end 44 which is affixed to the second arm 20 via rachet washers 40.

Preferably, the torsion means are adjustable. As shown in FIG. 4*a*, a coil spring torsion means 30 can be made adjustable by use of an adjustment bolt 48 which is affixed to the first end 34 of the coil spring 30. Loosening the adjustment bolt 48 provides less tension to the coil spring 30. Tightening the adjustment bolt 48 increases tension.

Figure 5:
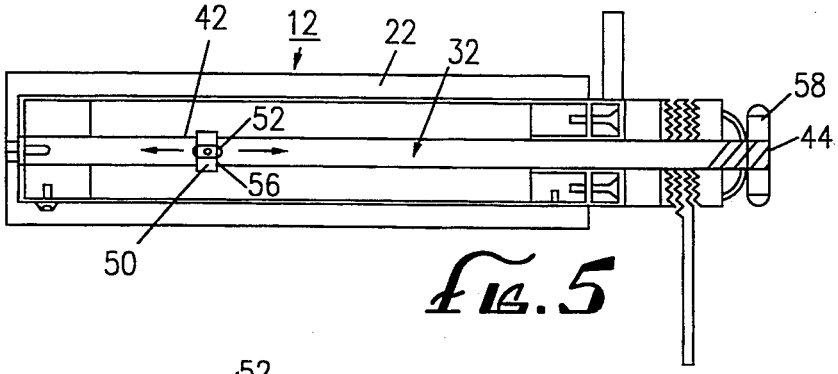
FIG. 5 is a side view in partial cross-section of another first bar useful in the invention, this view illustrating the use of a ring to adjust the; torsion strength of a torsion bar disposed within the first bar.

As shown in FIG. 5, where the torsion means is a torsion bar 32, the torsion means can be made adjustable by means of a ring 50 which can be slid axially along the torsion bar 32. The ring 50 has a dog 52 which is received and retained within one of several notches 54 disposed within the first bar 12. The ring 50 is selected so that it can be slid axially along the torsion bar 32, but it does not slip when the torsion bar 32 is turned radially. A set screw 56 can be disposed within the dog 52 to firmly affix the ring 50 to the torsion bar 32 at the predetermined location.

In another embodiment, the torsion means is readily interchangeable with similar torsion means of a different strength. This allows the device 10 to be used for a wide variety of exercises requiring widely different torsion resistance strengths. Accordingly, the invention 10 is also a kit comprising the device 10 of the invention plus one or more interchangeable torsion means of differing strength.

The rachet washers 40 allow for the "at-rest" disposition of the second bar 14 with respect to the third bar 16 to be; adjustably set at a predetermined distance by loosening the rachet washer attachment nut 58, allowing the arms 18 and 20 to pivot with respect to one another to a predetermined position, and then tightening down on the rachet attachment nut 58.

The invention 10 provides an inexpensive and easily maintained multiple-muscle exercise device which can be easily stored and transported by a user within a suitcase or other convenient travel means. FIG. 11 illustrates a number of ways that the device 10 can be used to exercise different muscles.

FIG. 11A illustrates how the device 10 can be used to strengthen stomach muscles. The first bar 12 is placed to the rear of the user and the second and third bars 14 and 16 are placed in front of the user. The user then squeezes the second and third bars 14 and 16 toward each other using his or her chest and legs.

FIG. 11B illustrates how the device 10 can be used to strengthen triceps muscles. The user places the first bar 12 against his or her back. The user then squeezes the second and third bars 14 and 16 toward each other by pressing downward on the upper-most arm with the user's hands.

FIG. 11C illustrates how the device 10 can be used to strengthen biceps muscles. Again, the user places the first bar 12 against his or her back. In this case, however, the user squeezes the second and third bars 14 and 16 toward each other by pressing upward on the Bower-most arm with the user's hands.

FIG. 11D illustrates how the device 10 can be used to strengthen the chest muscles of the user. The first bar 12 is positioned against the chest of the user and the second and third bars 14 and 16 are squeezed toward each other with the user's arms.

FIG. 11E illustrates how the device 10 can be used to strengthen the user's thigh muscles. The first bar 12 is placed between the user's legs and the second and third bars 14 and 16 are squeezed toward each other by use of the user's legs.

FIG. 11F illustrates how the device 10 can be used to strengthen other leg muscles. The user lies on his or her back with the first bar 12 resting on the floor. The user then squeezes the second and third bars 14 and 16 toward each other using his or her legs.

FIG. 11G illustrates how the device 10 can be used to strengthen triceps and shoulder muscles. The user sits upon the first bar 12 with the second and third bars 14 and 16 disposed behind the user. The user then presses downwardly on the upper-most (second 14 or third 16) bar using his or her hands placed behind the back.

FIG. 11H illustrates how the device 10 can be used to strengthen chest, shoulder and triceps muscles. The device 10 is placed on a flat surface with the first bar 12 disposed away from the user. The user then squeezes the second and third bars 14 and 16 together by pressing down on the upper-most bar with his or her arms.

FIG. 11I illustrates how the device 10 can be used to strengthen other leg muscles. The first bar 12 is placed beneath the user's knees. One of the other bars 14 and 16 is placed in front of the user's lower legs and the remaining bar is placed to the front of the user's upper legs. The user then squeezes the second and third bars 14 and 16 together by lifting his or her legs.

FIG. 11J illustrates an alternative procedure for strengthening leg muscles. In this procedure, the user sits upon the first bar 12 and one of the other bars 14 or 16. The user then lifts the remaining bar 14 or 16 with his or her legs.

FIG. 11K illustrates how the device 10 can be used to strengthen back muscles. The user sits on the second or third bar 14 or 16 with the first bar 12 positioned behind the user and the remaining bar 14 or 16 disposed along the user's back. The user then thrusts the bar 14 or 16 disposed along his or her back in a rearward fashion by sitting up straight.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A portable exercise device comprising:

(a) a first bar having a distal end and a proximal end;

(b) a first arm having a distal end and a proximal end, the proximal end of the first arm being attached to the proximal end of the first bar, such that the first bar and the first arm are disposed substantially at right angles;

(c) a second arm having a distal end and a proximal end, the proximal end of the second arm being swivably attached to an end of the first bar such that the first bar and the second arm are disposed substantially at right angles;

(d) a second bar having a distal end and a proximal end, the proximal end of the second bar being attached to the distal end of the first arm such that the second bar is disposed at substantially right angles to the first arm and such that the second bar is disposed substantially parallel with the first bar;

(e) a third bar having a distal end and a proximal end, the proximal end of the third bar being attached to the distal end of the second arm such that the third bar is disposed at substantially right angles to the second arm and such that the third bar is disposed substantially parallel with the first and second bars; and (f) torsion means for resisting the swiveling of the second arm with respect to the first bar wherein the first bar, the second bar and the third bar are retained in spaced-apart, parallel relationship with one another solely by the first arm and the second arm.

2. The portable exercise device of claim 1 wherein the first arm is rigidly affixed to the first bar.

3. The portable exercise device of claim 1 wherein the at-rest orientation of the second bar to the third bar is adjustable.

4. The portable exercise device of claim 1 wherein the second arm is attached to the first bar by a pair of cooperating rachet washers.

5. The portable exercise device of claim 1 wherein the length of the first and second arms are adjustable.

6. The portable exercise device of claim 1 wherein the first and second arms both comprise a pair of telescoping moieties, which moieties are affixed to one another by pins disposed within matching notches in the moieties.

7. The portable exercise device of claim 1 wherein the torsion means comprises a spring affixed at a first end to the first bar and at a second end to the second arm.

8. The portable exercise device of claim 1 wherein the torsion means comprises a torsion bar affixed at a first end to the first bar and at a second end to the second arm.

9. The portable exercise device of claim 1 wherein the strength of the torsion means is adjustable.

10. The portable exercise device of claim 1 wherein the torsion means is a coiled spring and the spring is adjustable by turning an adjustment bolt which is affixed to a first end of the spring.

11. The portable exercise device of claim 1 wherein the torsion means is a torsion bar which is affixed at a second end to the second arm and at a first end to a ring which is slidably disposed around the torsion bar, the ring having a dog which is sized and dimensioned to be alternatively received and retained within a plurality of notches disposed in the first bar.

12. The portable exercise device of claim 1 wherein the proximal end of the second arm is attached to the proximal end of the first bar.

13. The portable exercise device of claim 1 wherein the proximal end of the second arm is attached to the distal end of the first bar.

14. The portable exercise device of claim 1 wherein the second arm is attached to the first bar by a pair of cooperating washers.

15. The portable exercise device of claim 1 wherein the torsion means comprises a spring.

16. The portable exercise device of claim 1 wherein the torsion means comprises a torsion bar.

17. A portable exercise device comprising:

(a) a first bar having a distal end and a proximal end;

(b) a first arm having a distal end and a proximal end, the proximal end of the first arm being rigidly attached to the proximal end of the first bar, such that the first bar and the first arm are disposed substantially at right angles;

(c) a second arm having a distal end and a proximal end, the proximal end of the second arm being swivably attached to the proximal end of the first bar such that the first bar and the second arm are disposed substantially at right angles;

(d) a second bar having a distal end and a proximal end, the proximal end of the second bar being attached to the distal end of the first arm such that the second bar is disposed at substantially right angles to the first arm and such that the second bar is disposed substantially parallel with the first bar;

(e) a third bar having a distal end and a proximal end, the proximal end of the third bar being attached to the distal end of the second arm such that the third bar is disposed at substantially right angles to the second arm and such that the third bar is disposed substantially parallel with the first and second bars;

(f) a spring disposed with the first bar and affixed at a first end to the first bar and at a second end to the second arm for resisting the swiveling of the second arm with respect to the first bar;

wherein the second arm is attached to the first bar by a pair of cooperating washers.

18. A kit comprising:

(a) a portable exercise device comprising:

(i) a first bar having a distal end and a proximal end;

(ii) a first arm having a distal end and a proximal end, the proximal end of the first arm being attached to the proximal end of the first bar, such that the first bar and the first arm are disposed substantially at right angles;

(iii) a second arm having a distal end and a proximal end, the proximal end of the second arm being swivably attached to an end of the first bar such that the first bar and the second arm are disposed substantially at right angles;

(iv) a second bar having a distal end and a proximal end, the proximal end of the second bar being attached to the distal end of the first arm such that the second bar is disposed at substantially right angles to the first arm and such that the second bar is disposed substantially parallel with the first bar;

(v) a third bar having a distal end and a proximal end, the proximal end of the third bar being attached to the distal end of the second arm such that the third bar is disposed at substantially right angles to the second arm and such that the third bar is disposed substantially parallel with the first and second bars; and (vi) first torsion means for resisting the swiveling of the second arm with respect to the first bar; and (b) a second torsion means for resisting the swiveling of the second arm with respect to the first bar, said second torsion means being interchangeable with the first torsion means.

19. A portable exercise device comprising:

(a) a first bar having a distal end and a proximal end;

(b) a first arm having a distal end and a proximal end, the proximal end of the first arm being rigidly attached to the proximal end of the first bar, such that the first bar and the first arm are disposed substantially at right angles;

(c) a second arm having a distal end and a proximal end, the proximal end of the second arm being swivably attached to the proximal end of the first bar such that the first bar and the second arm are disposed substantially at right angles;

(d) a second bar having a distal end and a proximal end, the proximal end of the second bar being attached to the distal end of the first arm such that the second bar is disposed at substantially right angles to the first arm and such that the second bar is disposed substantially parallel with the first bar;

(e) a third bar having a distal end and a proximal end, the proximal end of the third bar being attached to the distal end of the second arm such that the third bar is disposed at substantially right angles to the second arm and such that the third bar is disposed substantially parallel with the first and second bars;

(f) torsion means for resisting the swiveling of the second arm with respect to the first bar;

wherein the second arm is attached to the first bar by a pair of cooperating washers.

* * * * *